US010631615B2

(12) United States Patent
Golding

(10) Patent No.: US 10,631,615 B2
(45) **Date of Patent: *Apr. 28, 2020**

(54) SYSTEM AND METHOD FOR INTERCHANGEABLE COSMETIC CONTAINER

(71) Applicant: Tight Line Cosmetics LLC, Farmingdale, NY (US)

(72) Inventor: Jessica Golding, Farmingdale, NY (US)

(73) Assignee: Tightline Cosmetics, Farmingdale, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/038,420

(22) Filed: Jul. 18, 2018

(65) Prior Publication Data

US 2018/0317631 A1 Nov. 8, 2018

Related U.S. Application Data

(63) Continuation of application No. 15/294,523, filed on Oct. 14, 2016, now Pat. No. 10,051,942.

(51) Int. Cl.

| | |
|---|---|
| ***B43K 27/02*** | (2006.01) |
| ***A45D 40/24*** | (2006.01) |
| ***A45D 40/26*** | (2006.01) |
| ***A46B 9/02*** | (2006.01) |
| ***A45D 34/06*** | (2006.01) |
| ***A45D 34/04*** | (2006.01) |

(52) U.S. Cl.

CPC ..... *A45D 40/24* (2013.01); *A45D 34/045* (2013.01); *A45D 34/06* (2013.01); *A45D 40/265* (2013.01); *A46B 9/021* (2013.01)

(58) Field of Classification Search

CPC .... A45D 40/24; A45D 40/265; A45D 40/267; A45D 34/06; A45D 34/045; A45D 34/046

USPC ..... 401/17

See application file for complete search history.

(56) References Cited

U.S. PATENT DOCUMENTS

| | | | | |
|---|---|---|---|---|
| 2,691,184 | A * | 10/1954 | Miller | A45D 34/045 401/129 |
| 6,464,418 | B1 * | 10/2002 | Visser | A45D 33/00 206/509 |
| 6,637,963 | B2 * | 10/2003 | Huang | A45D 40/24 132/314 |
| 2004/0086317 | A1 * | 5/2004 | Hanna | A45C 11/008 401/19 |
| 2006/0062630 | A1 * | 3/2006 | Yeh | B43K 19/003 401/18 |

* cited by examiner

*Primary Examiner* — Jennifer C Chiang

(74) *Attorney, Agent, or Firm* — White and Williams LLP

(57) ABSTRACT

A container for carrying cosmetic product comprises a central container with first and second openings, the first opening configured to accept a first vial and the second opening configured to accept a second vial wherein the first opening and the second opening are substantially the same size, and wherein the first vial and the second vial are substantially the same size; and two caps, each cap having an open end and a closed end, the cap designed to accept a cap insert into the open end, wherein the cap insert comprises a rod, wherein the rod is configured to accept an applicator tip, and wherein the rod is configured to be inserted into the vial when the cap is placed over the first opening or the second opening of the central container.

5 Claims, 15 Drawing Sheets

SYSTEM AND METHOD FOR INTERCHANGEABLE COSMETIC CONTAINER

PRIORITY

This application is a continuation of U.S. patent application Ser. No. 15/294,523, filed Oct. 14, 2016, entitled "System and Method for Interchangeable Cosmetic Container," which claims the benefit of U.S. Provisional Application No. 62/241,495, filed Oct. 14, 2015, the entirety of which is incorporated herein by reference.

BACKGROUND OF THE INVENTION

The present disclosure relates to a cosmetic container having the ability to carry multiple cosmetics in a single container and the ability to interchange the cosmetics carried in the container.

Users of cosmetics often use numerous types of product, including multiple products to be applied to various areas surrounding the eyes, products to be applied to the lips, and others. These products also come in numerous colors and formulas, and they can be cumbersome to carry. As a result, there is a need for a container that can carry multiple products in a single container, and accepts similarly sized vials of different types of product.

SUMMARY OF THE INVENTION

A container for carrying cosmetic product comprises a central container comprising a first opening and a second opening, the first opening configured to accept a first vial inserted into the first opening, and the second opening configured to accept a second vial inserted into the second opening, wherein the first opening and the second opening are substantially the same size, and wherein the first vial and the second vial are substantially the same size; and two caps, each cap having an open end and a closed end, the cap designed to accept a cap insert into the open end, wherein the cap insert has an insert diameter smaller than a cap diameter of the open end, such that when the cap insert is inserted into the open end, there remains an outer circumference of the open end capable of covering the first opening or the second opening of the central container despite the presence, within the open end, of the cap insert, wherein the cap insert comprises a rod, wherein the rod is configured to accept an applicator tip, and wherein the rod is configured to be inserted into the vial when the cap is placed over the first opening or the second opening of the central container.

In one aspect, the first vial and the second vial are positioned closer to the center of the central container than the first cap and the second cap. In one aspect, where in the rod is configured to accept a plurality of applicator tip styles. In one aspect, the container further comprises a wiper positioned at a top end of the first vial such that the applicator contacts the wiper when the applicator is removed from the vial.

DETAILED DESCRIPTION OF ASPECTS OF THE INVENTION

Figure 1:
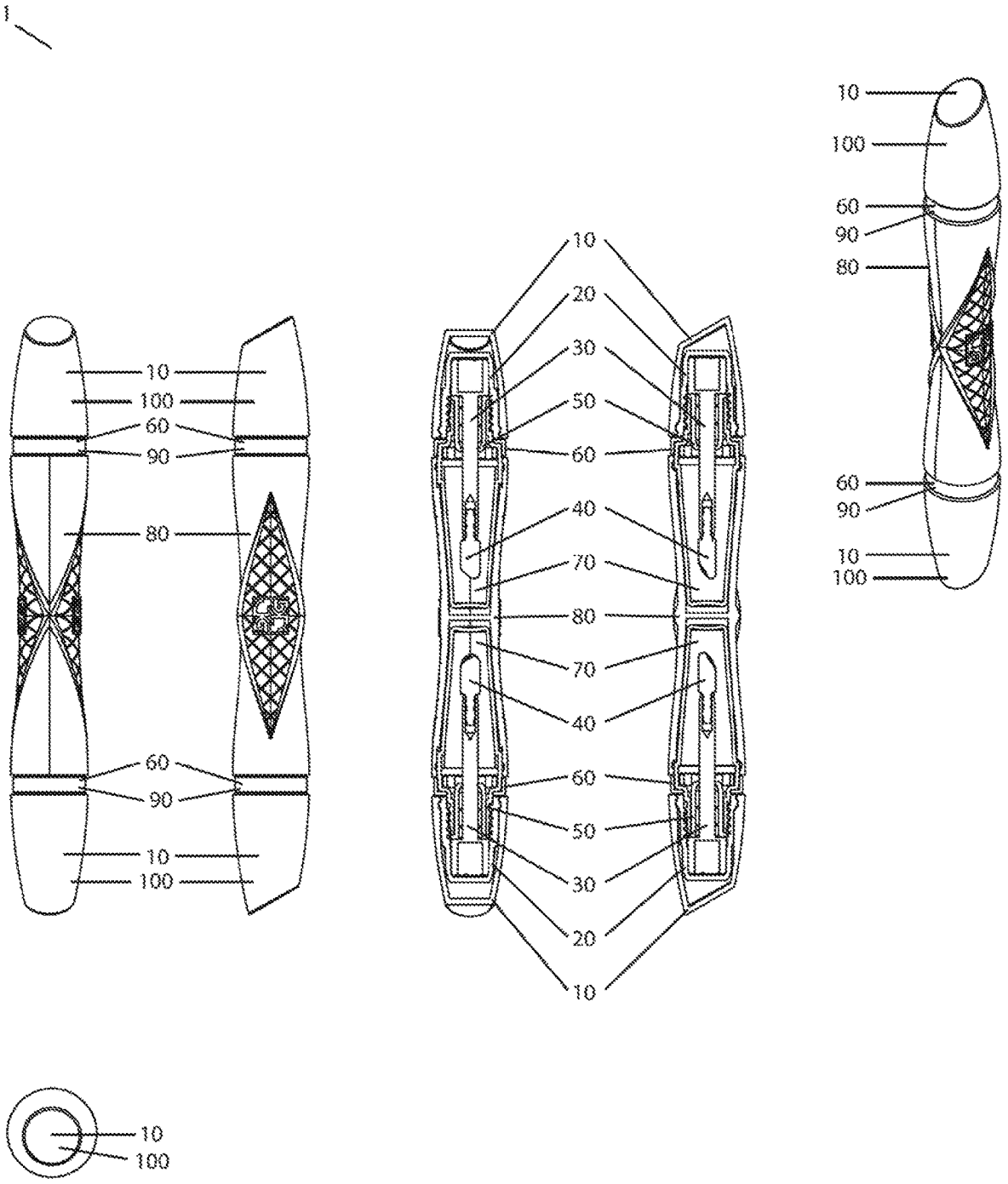
FIG. 1 shows side, cross-sectional, and perspective views of an interchangeable cosmetic container in accordance with one aspect of the present disclosure

Turning now to the figures, where like numbers refer to like elements. FIG. 1 shows a perspective cross-sectional view of an interchangeable cosmetic container in accordance with one aspect of the present disclosure. FIG. 1 shows an exterior front view and an exterior side view, with the exterior side view being rotated approximately 90 degrees. FIG. 1 also shows a cross-sectional front and side views and an angle view.

The cosmetic container 1 may include a cap 10 and a cap insert 20. The cap insert 20 may include a rod 30, an applicator 40 at the end of the rod 30. The container 1 may further contain a vial assembly 90 which includes a vial 70, a color band 60, and a wiper 50. The vial assembly 90 is inserted into a central container 80. When the container 1 is assembled as shown in FIG. 1, the applicator 40 is inserted into a vial 70 of the vial assembly 90. The rod 30 is connected to the cap 10 and cap 10 is then secured to the top of the central container 80, covering the vial 70. As shown in FIG. 1, the container 1 is symmetrical, in that it contains the same parts on the top and on the bottom, allowing two vials or product and two applicators to be carried in a single central container 80.

Figure 2:
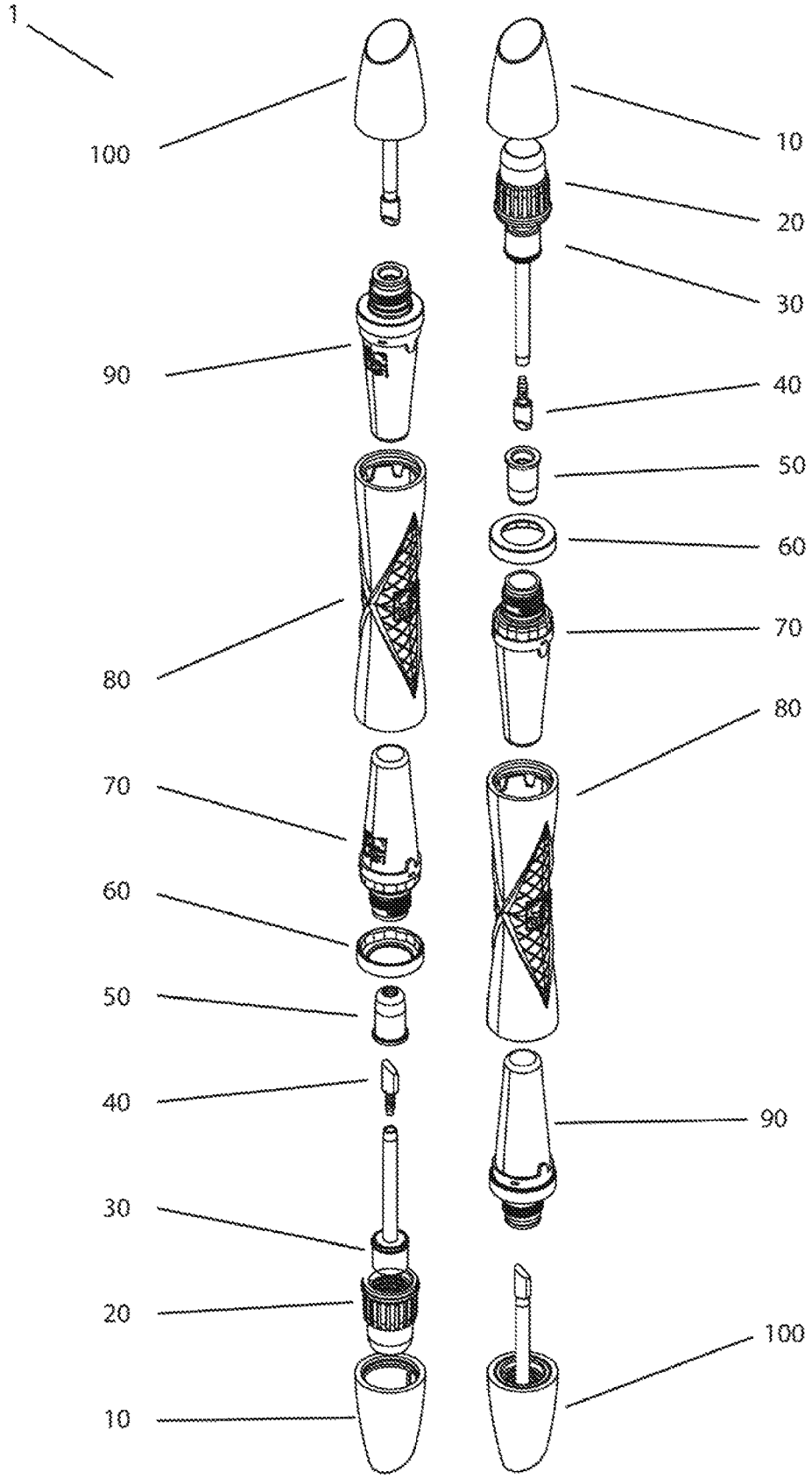
FIG. 2 shows an exploded view of an interchangeable cosmetic container in accordance with one aspect of the present disclosure.

FIG. 2 shows an exploded view of the interchangeable cosmetic container 1 in accordance with one aspect of the present disclosure. In the view shown on the left of FIG. 2, the parts of the container 1 are shown assembled at the top and unassembled at the bottom. In the right view, the parts of the container 1 are shown unassembled at the top and assembled at the bottom. As shown, the assembly 1 is symmetrical, and has the same parts inserted into the top and the bottom of central container 80 as discussed in detail below.

Cap assembly 100 includes the cap 10, the cap insert 20, and the rod 30 with an applicator 40 on the end of the rod 30. Vial assembly 90 includes a wiper 50, a color ring 60 and a vial 70. Vial 70 may contain cosmetic product (not shown) and may be configured to contain different types of cosmetic products. In non-limiting examples, vial 70 may contain cosmetic products such as lip product, eye product, nail product, or others as discussed. Applicator 40 may, in one aspect, be replaced by a different applicator corresponding to and appropriate for the product contained in vial 80. Applicators could include an angled "doe's foot" lip applicator, a mascara brush, an eyeliner brush, or any other applicator used to apply makeup or any other product that might be housed in vial 70.

Central container 80 has two or more openings 83 as shown in accordance with one non-limiting aspect. In one non-limiting aspect, openings 83 may be arranged at opposing ends of central container 80. This permits a vial assembly 90 to be inserted into one opening 83, and a second vial assembly 90 to be inserted into the other opening 83. This allows the user of the container 1 to reduce the number of separate containers needed to carry multiple makeup products. On the other end of central container 80 is another cap assembly 100, comprised of the cap 10, the cap insert 20 and the rod 30 with the applicator 40.

Containers known in the art store the product closer to the end of the container with the applicators closer to the center of central container 90. When a user wishes to apply product, the user removes the part of the container containing the product that person wishes to use. What is left in the user's hand is the entire remainder of the container, including the full amount of the product on the other side, which the user does not wish to use at that time. This results in a heavy item which can make applying makeup difficult, especially but not exclusively to one's own face. By contrast, in this aspect of the present disclosure, the product is stored closer to the center of container 90, with the outer cap insert 20 containing the rod 30 and the applicator 40 positioned on either end of central container 90. This arrangement more evenly distributes the relative weight, with the heavier aspects of the container, namely the product itself, closer to the center of mass of the container 1. This allows the person applying the makeup to hold a lighter implement in the hand, because one must only bring the weight of the cap insert 20 and the applicator 40, and not the vial full of product, up to one's face.

Figure 3:
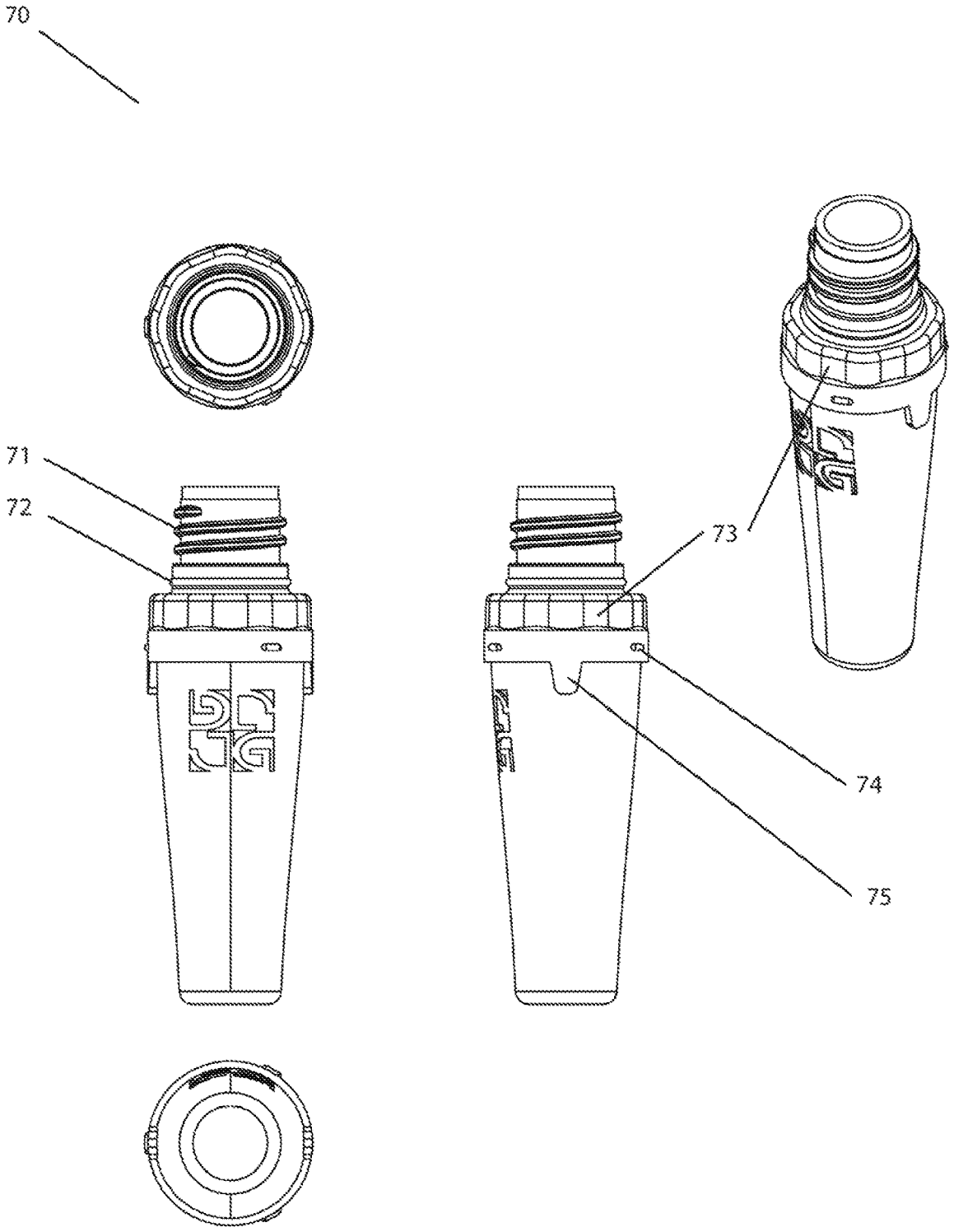
FIG. 3 shows top, bottom, side and perspective views of a vial in accordance with one aspect of the present disclosure.

FIG. 3 shows top, bottom, side and perspective views of vial 70 in accordance with one aspect of the present disclosure. Users of the product can own more than two vials 70 of product and can chose which two vials 70 of product to be inserted into central container 80. Accordingly, the user can carry the same central container daily, but with vials 70 containing different kinds of makeup each day. Screw threads 71 allow the vial 70 to be securely fastened to the central container when it is inserted. Locking bead 72 permits the color band 60 to be attached to the vial 70, and orientation scallops 73 prevent the color band 60 from rotating when attached. Three snap beads 74 allow the vial to snap into and out of the central container 80, as they are matched with snap beads 81 shown in FIG. 4. Rotation lug 75 matches up with rotation lug 82 in central container 80 as shown in FIG. 4, to ensure that the vial 70 and the rest of the vial assembly 90 are in the proper rotation relative to the central container 80.

Figure 4:
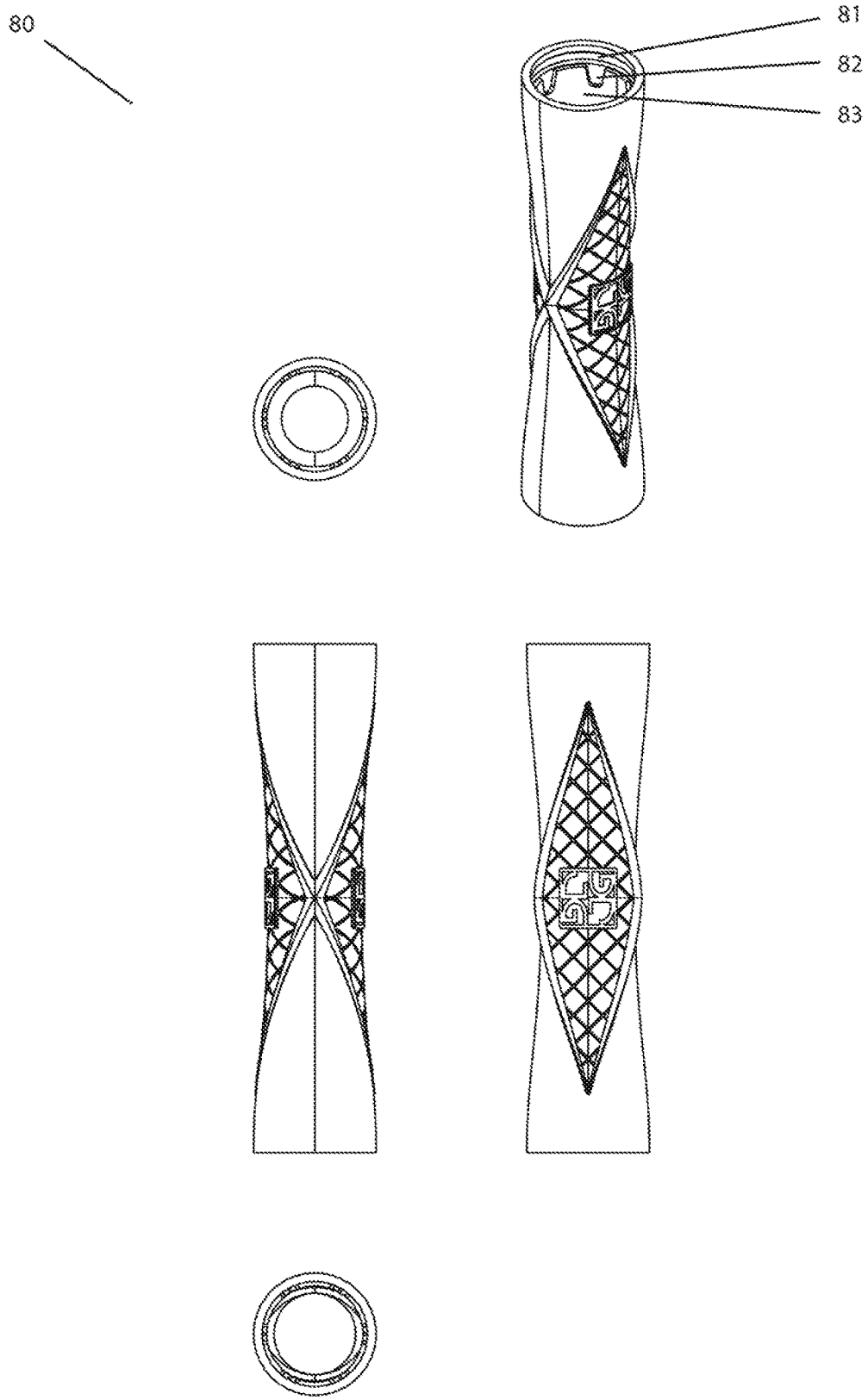
FIG. 4 shows top, bottom, side and perspective views of a container in accordance with one aspect of the present disclosure.

FIG. 4 shows top, bottom, side and perspective views of central container 80 in accordance with one aspect of the present disclosure. Central container 80 may include, in one aspect, snap beads 81 surrounding holes 83 so that the vial assembly 90 can be secured by snapping into the central container, though other fastening mechanisms could also be used. Central container 80 further comprises orientation lug 82 to align the vial 70 properly when inserted into the central container 80.

Figure 5:
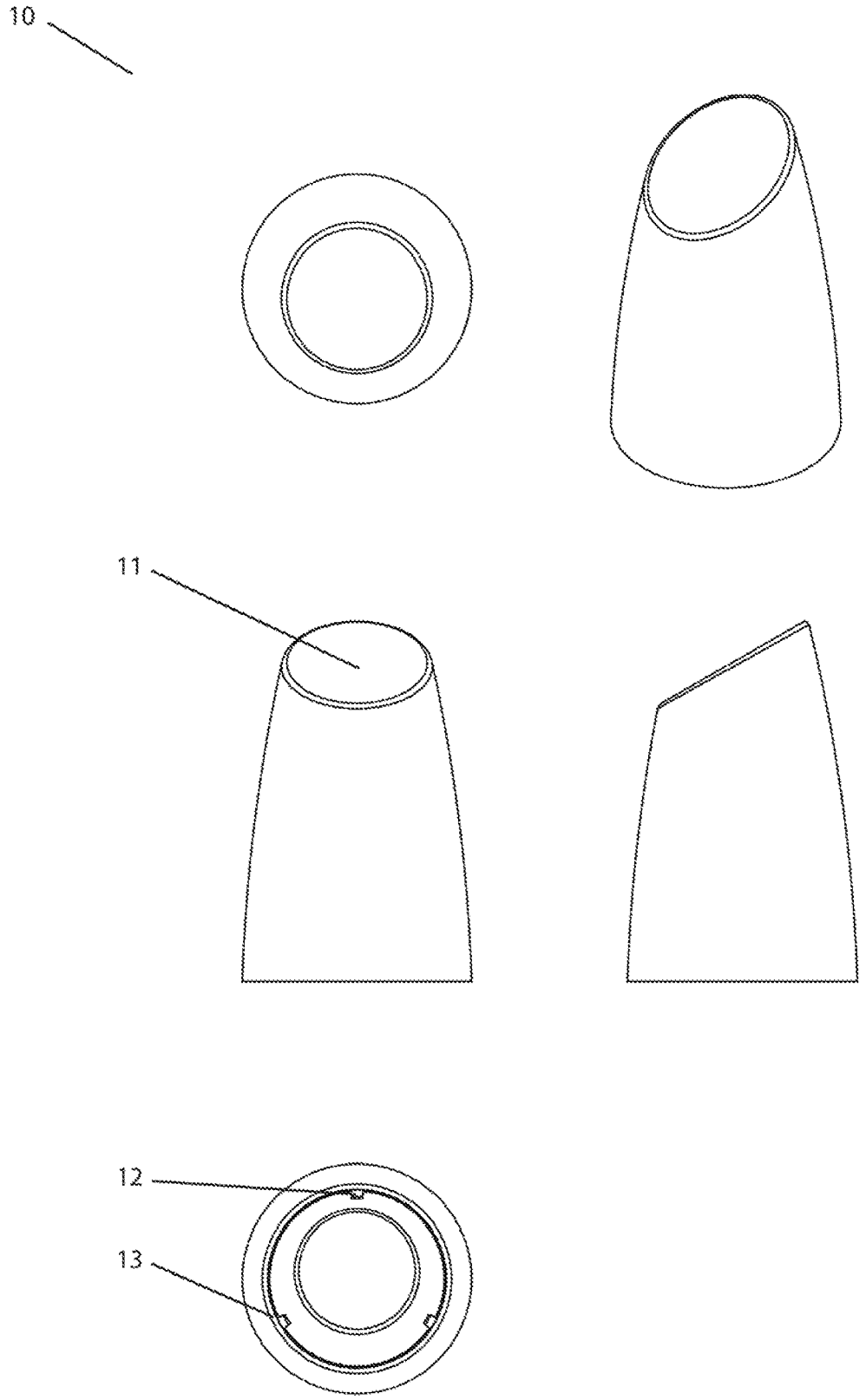
FIG. 5 shows top, bottom, side and perspective views of a cap in accordance with one aspect of the present disclosure.

FIG. 5 shows top, bottom, side and perspective views of cap 10 in accordance with one aspect of the present disclosure. The cap 10 has a beveled top 11 which allows for text or a drawing, such as a description of the applicator contained within the cap assembly 100. Alignment grooves 12 allow for the cap insert 30 to be aligned relative to the cap 10 when creating the cap assembly 100. Under cut locking feature 13 allows the cap insert to lock into the interior of the cap 10.

Figure 6:
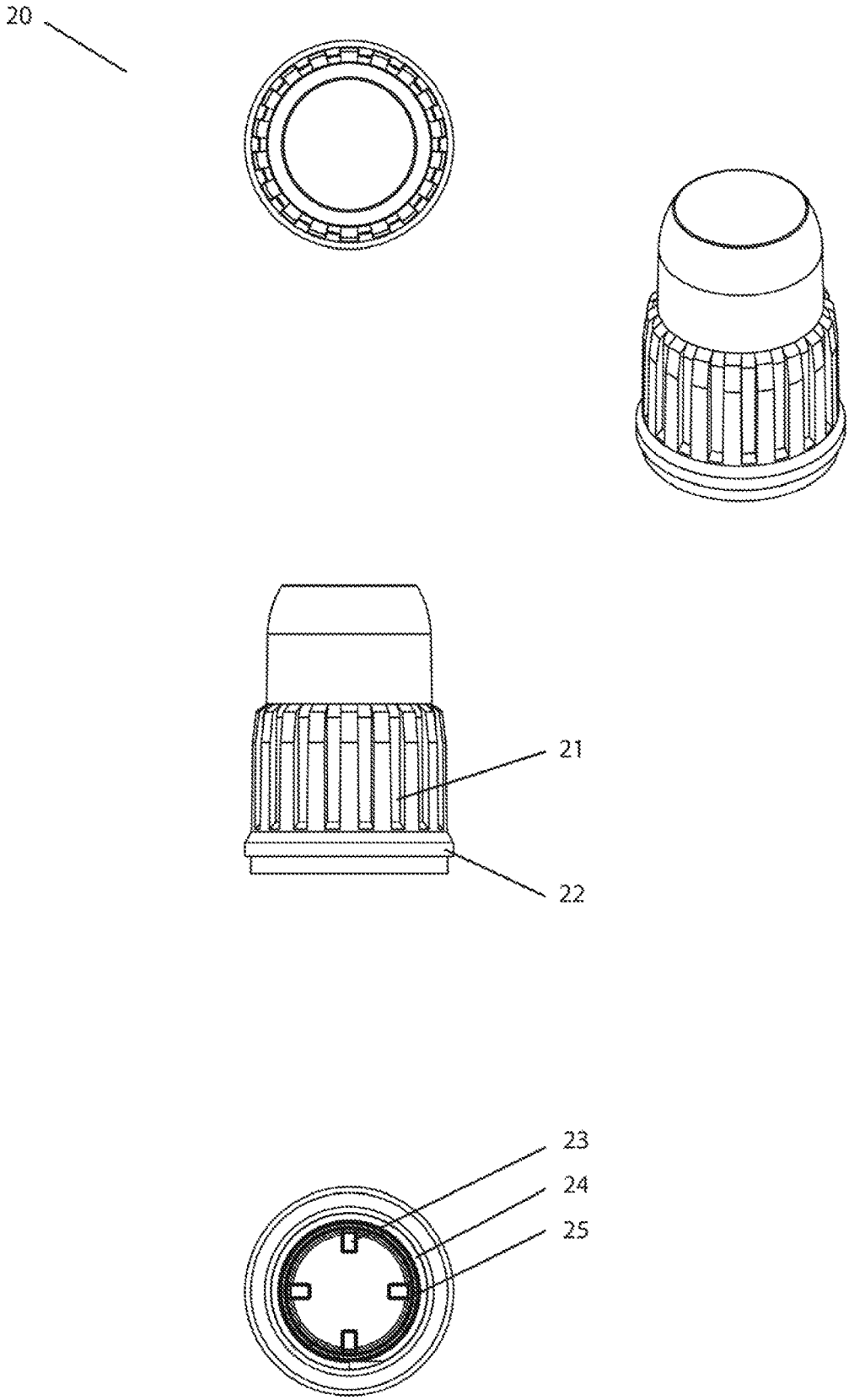
FIG. 6 shows top, bottom, side and perspective views of a cap insert in accordance with one aspect of the present disclosure.
Figure 7:
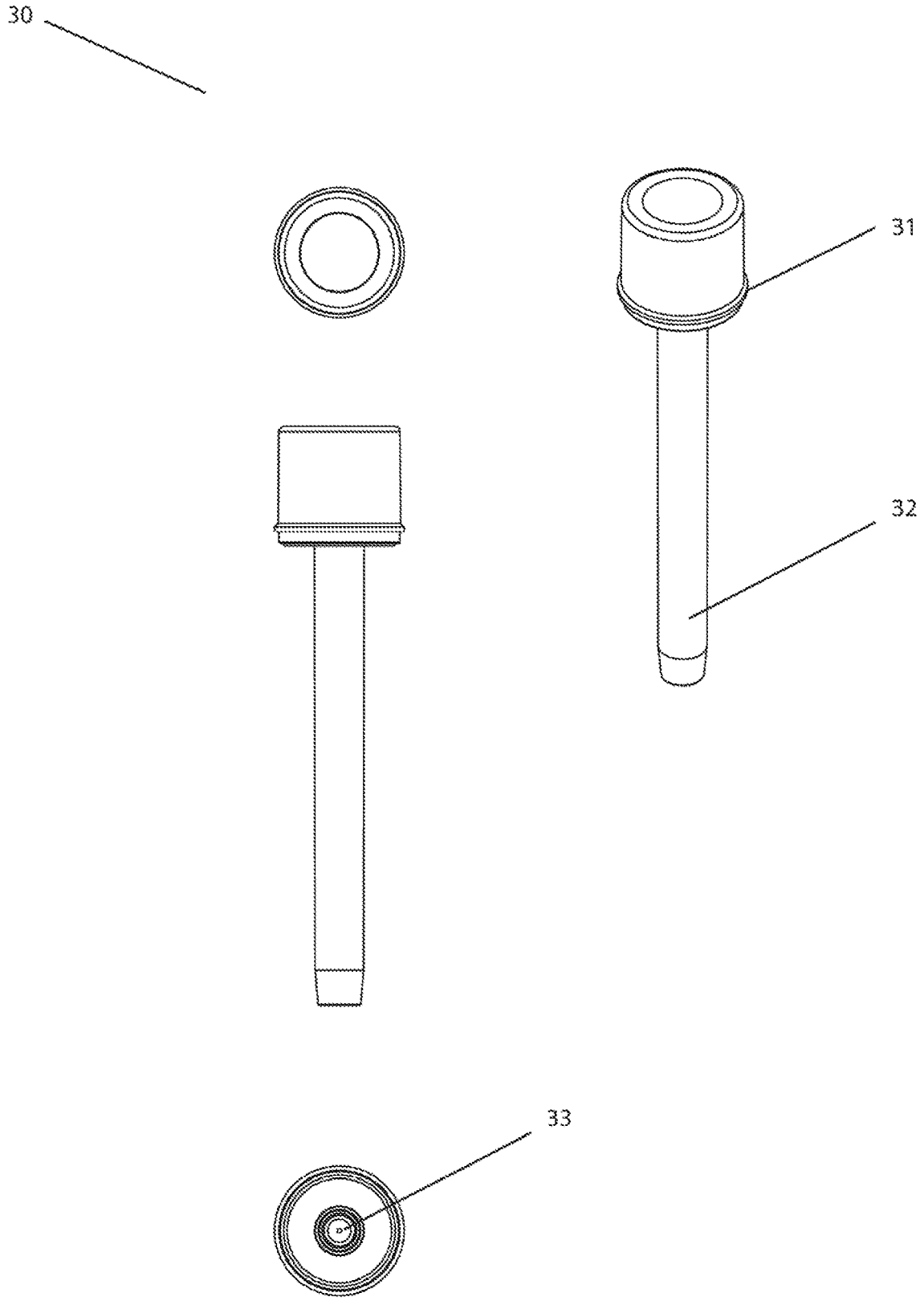
FIG. 7 shows top, bottom, side and perspective views of a rod in accordance with one aspect of the present disclosure.

FIG. 6 shows top, bottom, side and perspective views of cap insert 20 in accordance with one aspect of the present disclosure. The cap insert 20 may have a tapered appearance, with one end designed to fit into the cap 10, and the other end to accept and secure the top portion of the rod 30, shown in FIG. 7. Anti-rotational groove 21 interacts with outer cap alignment groove 12 to ensure alignment of the cap insert with the cap. Locking bead 22 is captured by undercut 13 of cap 10 when assembled into the cap assembly 100, so the cap insert 20 is locked in place. Standoff rib details 23 allow for location of the rod 30 in the cap insert 20. Threads 24 allow for closure when interacting with threads 71 on vial 70.

Figure 8:
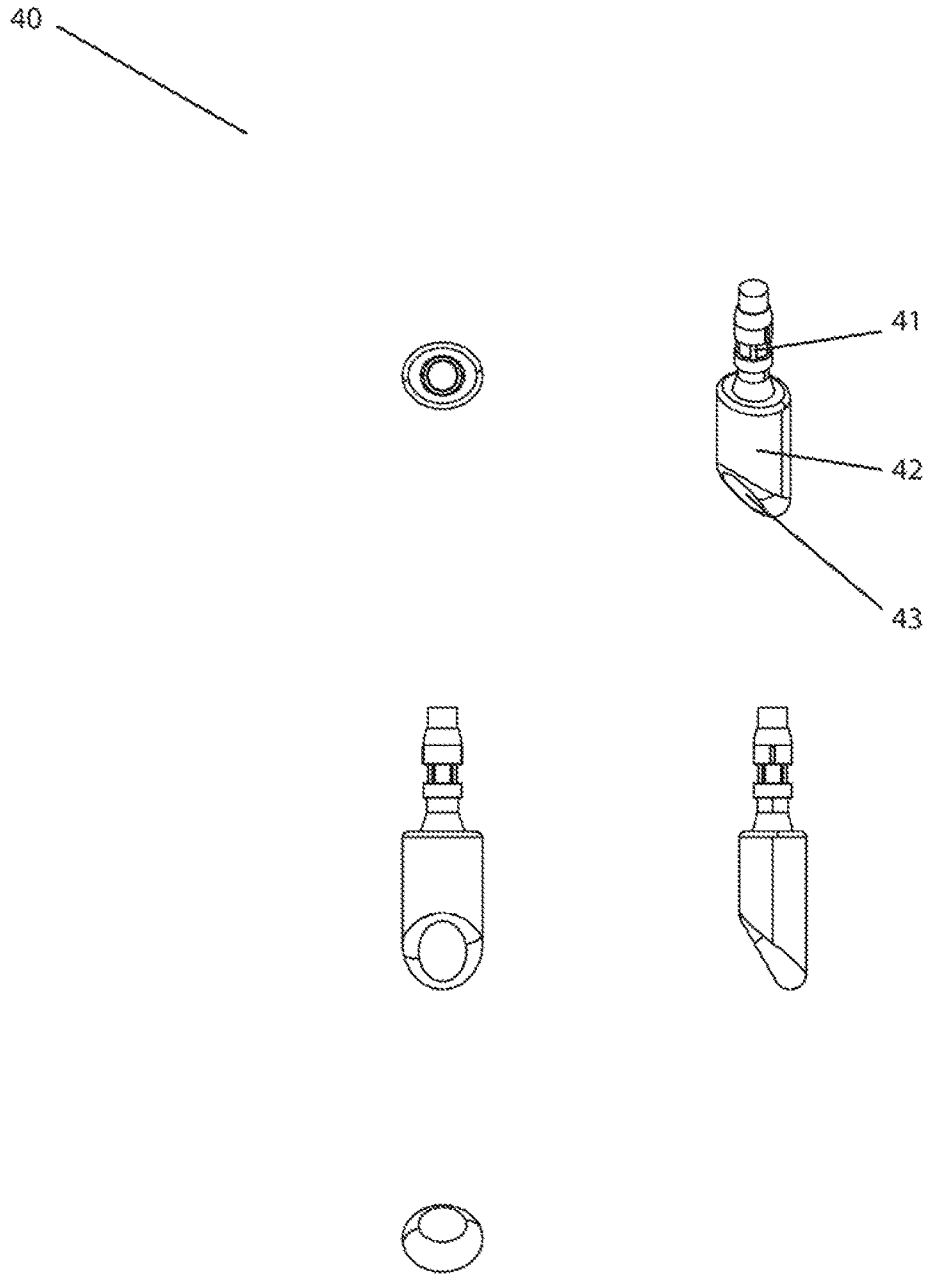
FIG. 8 shows top, bottom, side and perspective views of an applicator in accordance with one aspect of the present disclosure.
Figure 9:
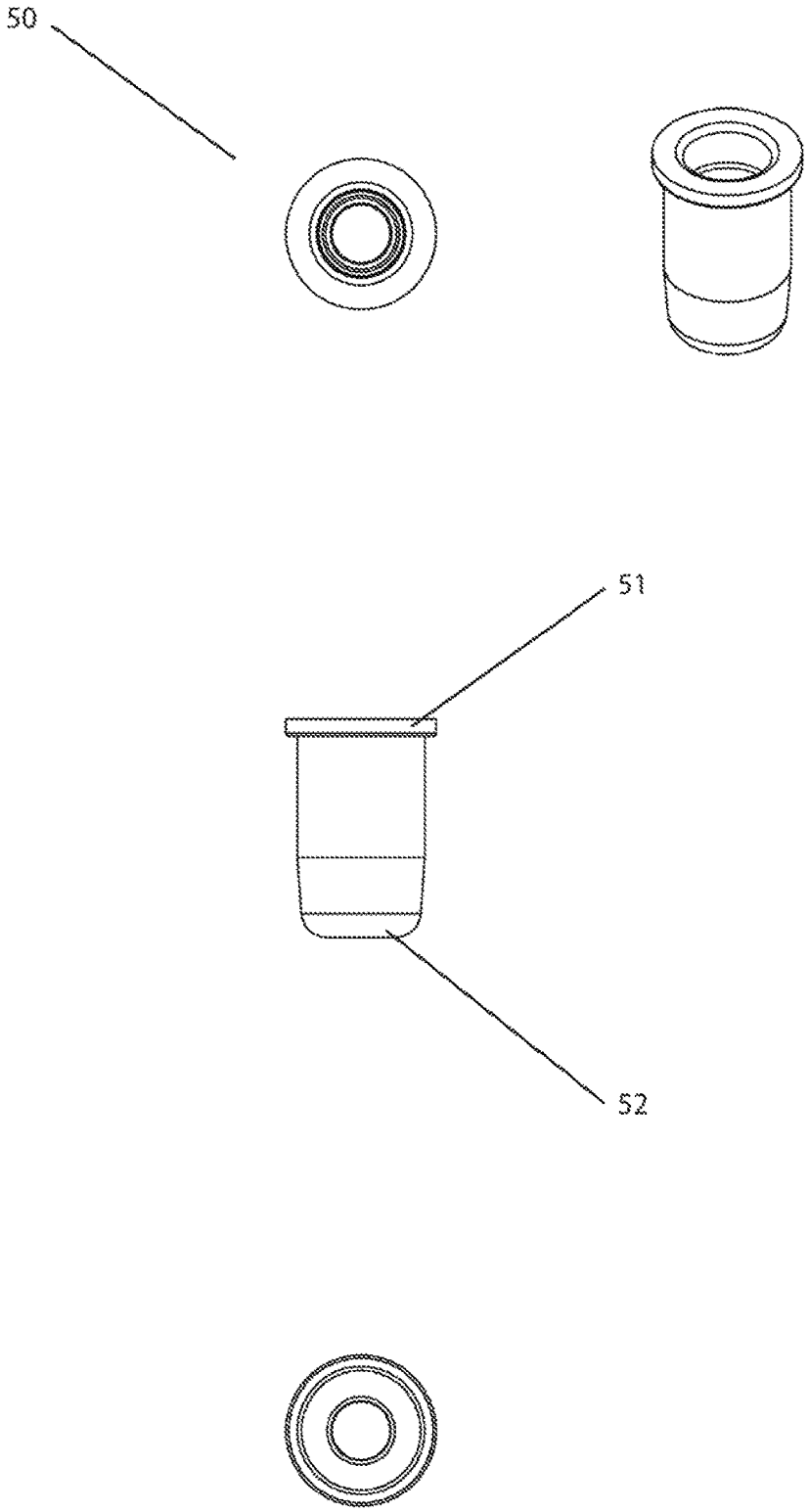
FIG. 9 shows top, bottom, side and perspective views of a wiper in accordance with one aspect of the present disclosure.

FIG. 8 shows top, bottom, side and perspective views of the rod 30 in accordance with one aspect of the present disclosure. The rod 30 contains including locking bead 31 on the top end which is designed to allow the rod to snap into the cap insert 20 via undercut 25. Stem 32 of the rod 30 holds applicator 40 as shown in FIG. 8. Applicators 40 are designed on the clocked outer surface 42 on one end to fit into the bottom end 32 of the rod 30. The other end 41 of the applicator 40 can be customized for the type of makeup to be applied with the applicator, and is designed to fit into the wiper 50 as shown in FIG. 9. Doe's foot applicator tip 43 is one exemplary applicator type. Other types, including brushes for lip and eye product, can be used interchangeably.

Figure 10:
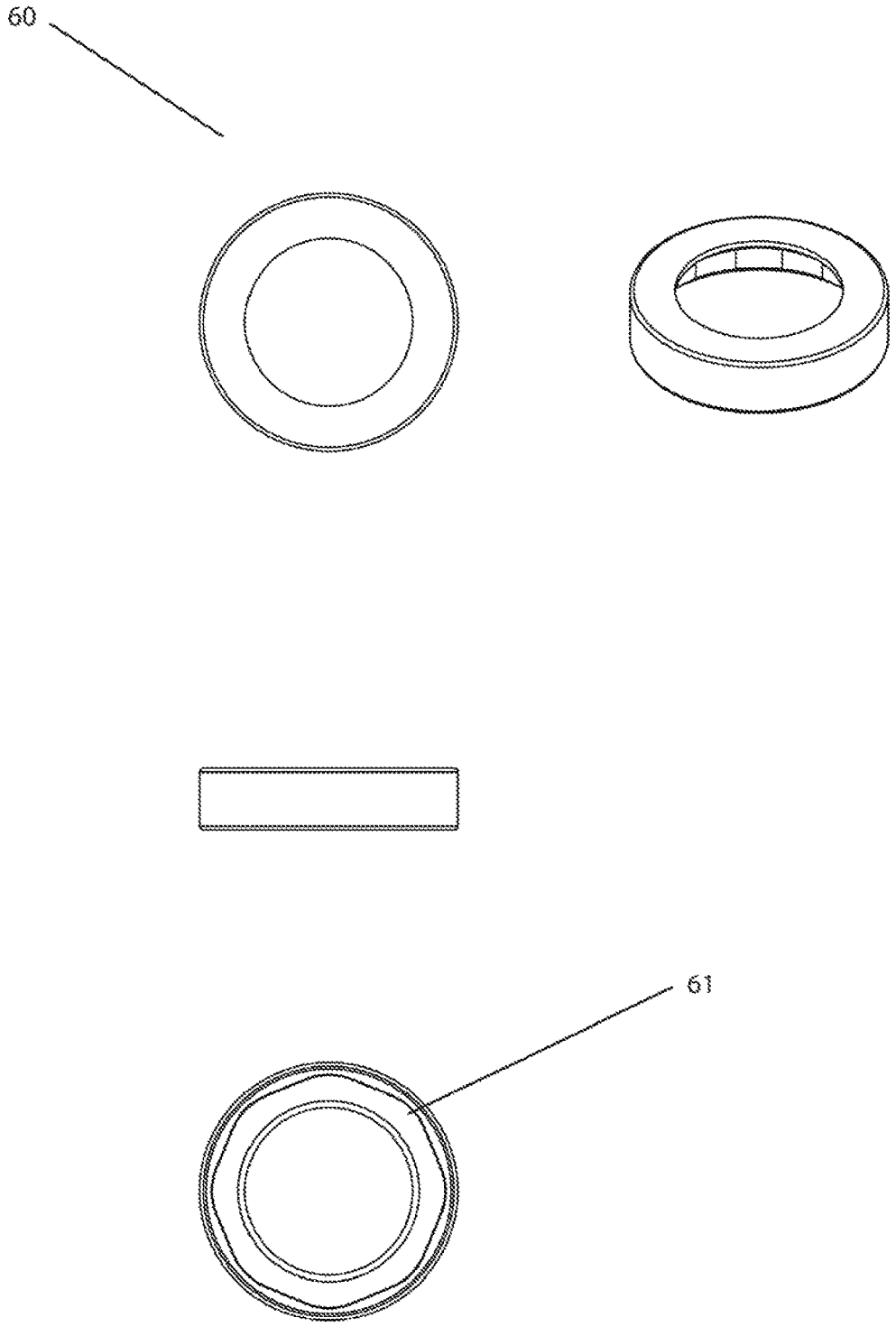
FIG. 10 shows top, bottom, side and perspective views of a color band in accordance with one aspect of the present disclosure.

Turning now to FIG. 9, a wiper 50 is shown. The wiper is used to wipe off excess product when the applicator 40 is removed from the vial 70. Sealing surface 51 prevents leakage of product. Flexible wiper flange 52 removes excess product from the applicator upon removal of the cap assembly 100 in anticipation of applying product. In one aspect the wiper 50 can fit into a color band 60 as shown in FIG. 10. Color band 60 can be interchangeable so that a person using the container 1 can know what kind of makeup and/or what color makeup is contained in one end or the other end of the container 1. Color band 60 is approximately the same diameter as the opening 83 of the central container 80. Color band 60 include orientation scallops 61 to prevent rotation of the color band 60.

Figure 11:
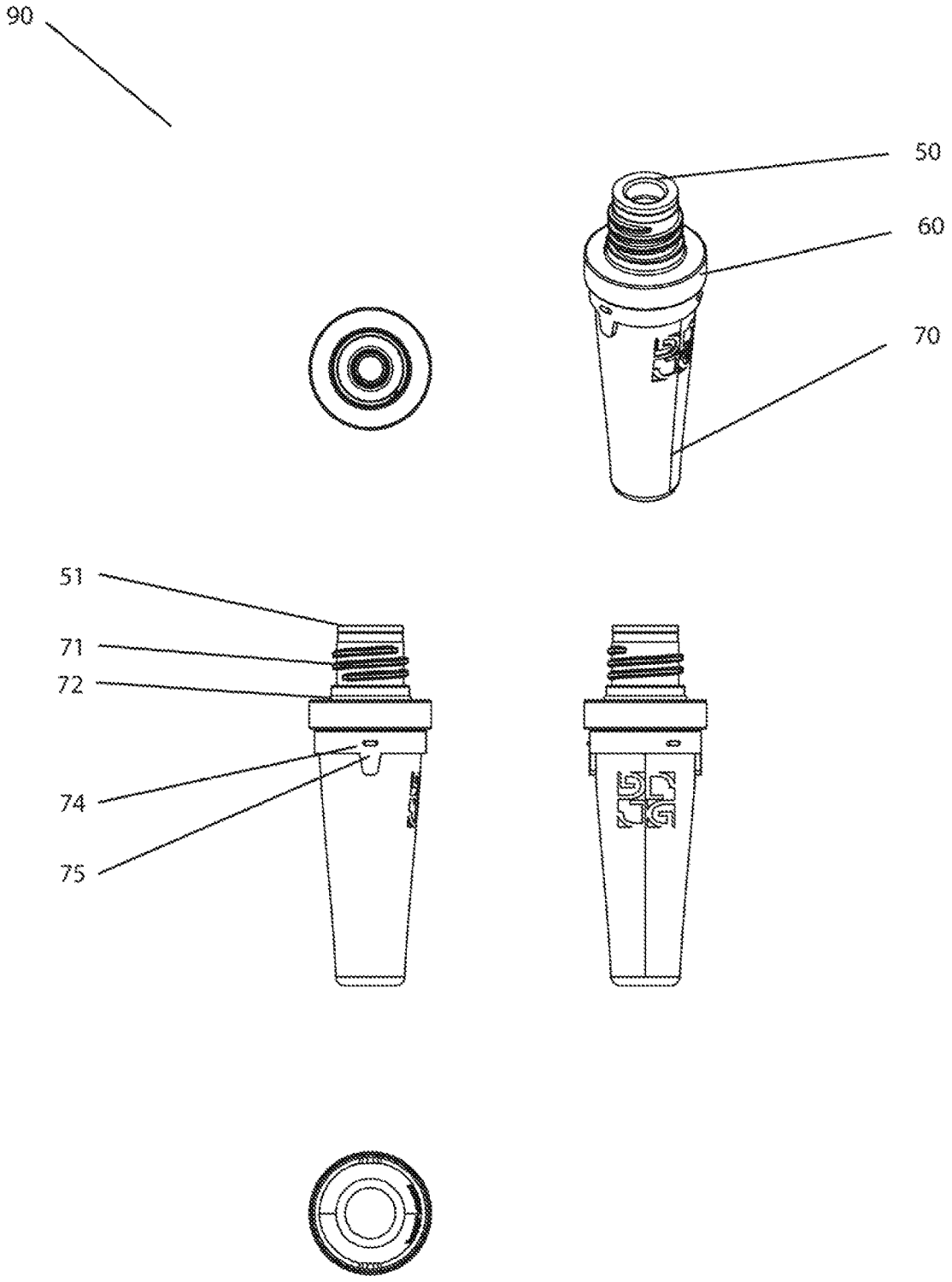
FIG. 11 shows top, bottom, side and perspective views of a vial assembly in accordance with one aspect of the present disclosure.

FIG. 11 shows the vial assembly 90 in accordance with one aspect of the present disclosure. Vial assembly 90 includes vial 70 and the parts of vial 70 as discussed with respect to FIG. 3, along with the wiper 50 as shown in and discussed with respect to FIG. 9, and the color ring as disclosed with respect to FIG. 10.

Figure 12:
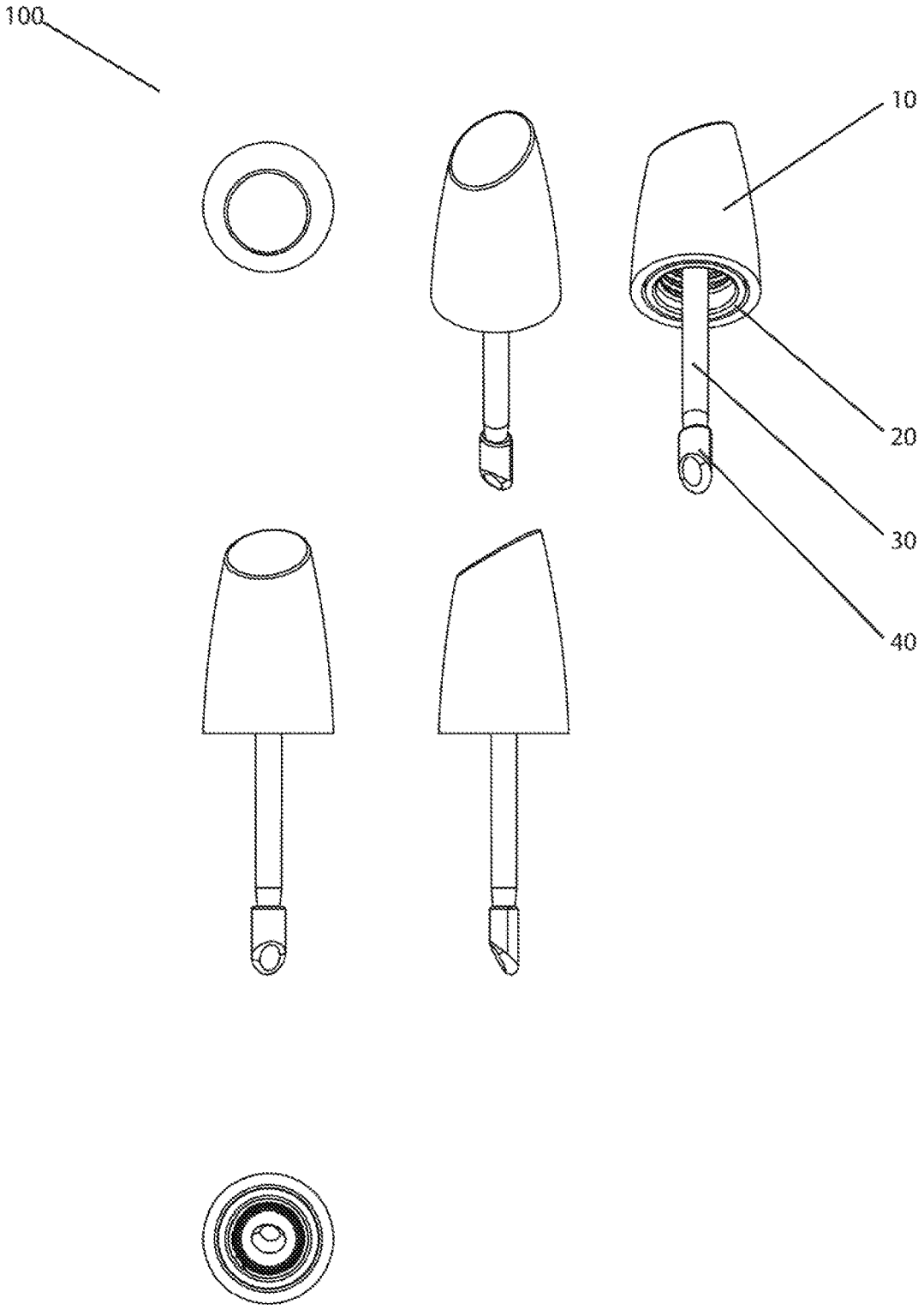
FIG. 12 shows top, bottom, side and perspective views of a cap assembly in accordance with one aspect of the present disclosure.

FIG. 12 shows the cap assembly 100 in accordance with one aspect of the present disclosure. Cap assembly 100 includes the cap 10 as described with respect to FIG. 5, the cap insert 20 as described with respect to FIG. 6, the rod 30 as described with respect to FIG. 7, and the applicator 40 as described with respect to FIG. 8. The rod 30 is inserted into the cap insert 20, which is inserted into the cap 10. Preferably, the components snap together, to form one cap assembly 100 which can be inserted into a vial 70 which is within the central container 80.

Figure 13:
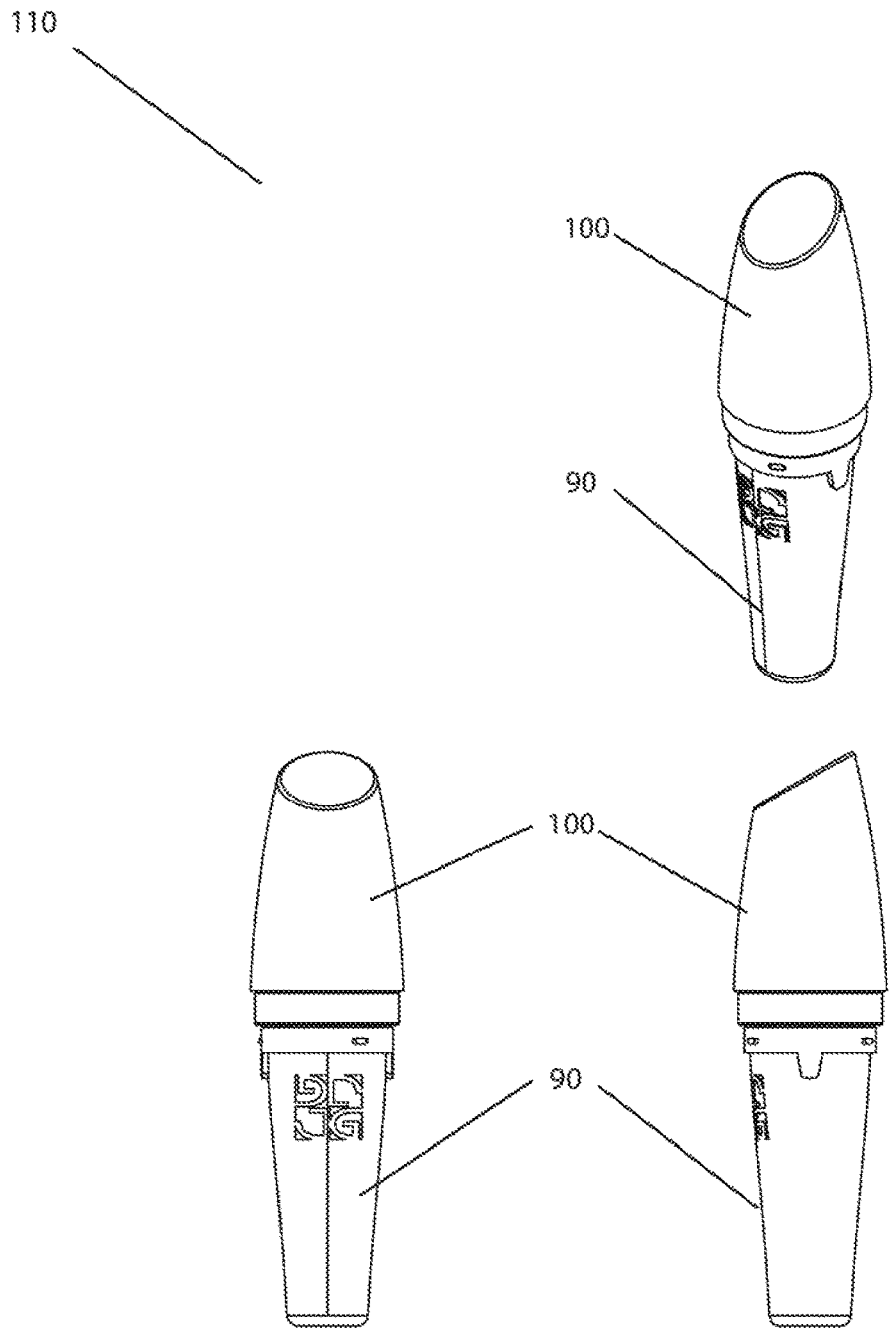
FIG. 13 shows side and top views of a cap and vial assembly in accordance with one aspect of the present disclosure.

FIG. 13 shows cap and vial assembly 110, which comprises a cap assembly 100 and a vial assembly 90, coupled together in accordance with one aspect of the present disclosure.

Figure 14:
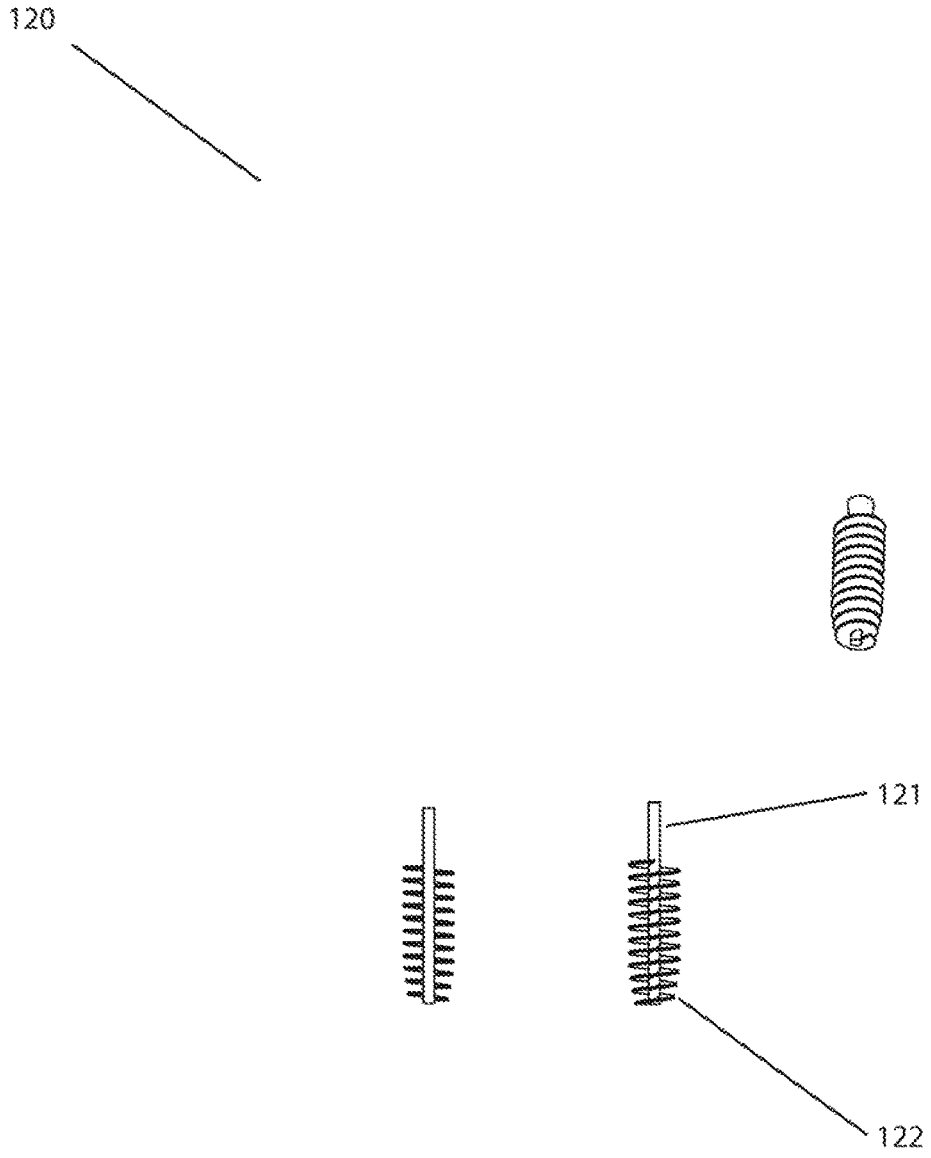
FIG. 14 shows a mascara brush in accordance with one aspect of the present disclosure.

FIG. 14 shows a mascara brush 120, which is another example of an applicator that can be used in place of applicator 40. Mascara brush 120 includes insertion tip 121 for mounting into the cap insert 30, and flexible bristles 122 for application of mascara to eye lashes.

Figure 15:
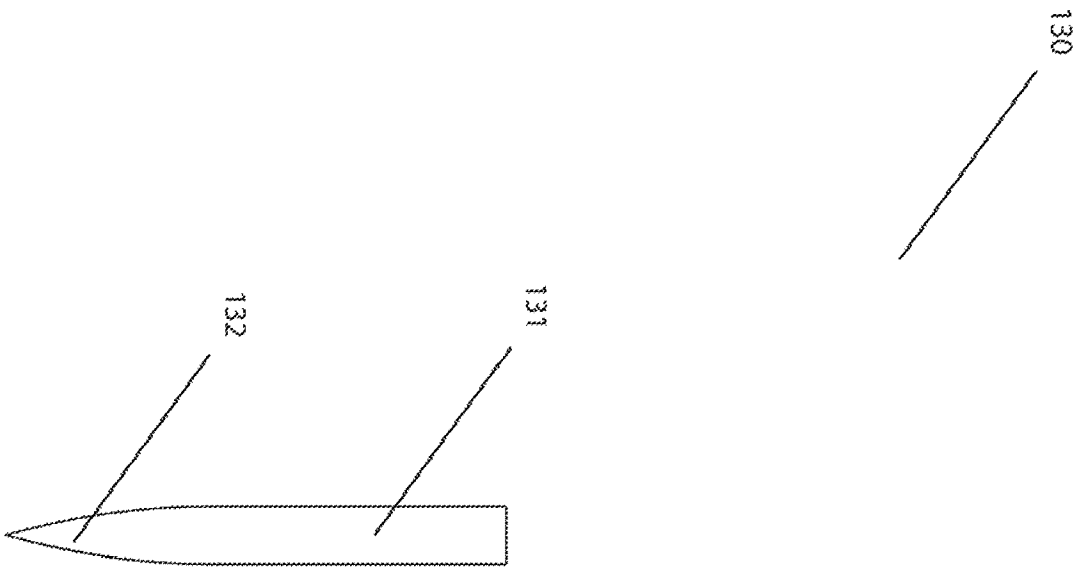
FIG. 15 shows an eyeliner applicator in accordance with one aspect of the present disclosure.

FIG. 15 shows an eyeliner brush 130, which is another example of an applicator that can be used in place of applicator 40. Eyeliner brush 130 includes insertion tip 131 for mounting into the cap insert 30, and an application surface 132 for application of eye liner.

While the above description of one embodiment is instructive, the specific limitations set forth in the specification and the figures should not be construed or read as necessary limitations on the invention, but merely as exemplars of one embodiment. Persons having skilling the art will realize that while the disclosure is described in reference to makeup, other types of product that can, be inserted in a vial and applied with an applicator can also be used.

What is claimed is:

1. A container for carrying cosmetic product stored in a first vial and a second vial, each having a cap insert, the container comprising:

a. a central container comprising a first opening and a second opening;

b. the first opening configured to accept the first vial inserted into the first opening, wherein one of the first opening and the first vial have at least one protrusion and the other of the first opening and the first vial have at least one recess to accommodate the at least one protrusion, wherein the at least one protrusion and at least one recess prevent rotation of the first vial when placed within the first opening;

c. the second opening configured to accept the second vial inserted into the second opening, wherein one of the second opening and the second vial have at least one protrusion and the other of the second opening and the second vial have at least one recess to accommodate the at least one protrusion, wherein the at least one protrusion and at least one recess prevent rotation of the second vial when placed within the second opening, wherein the first opening and the second opening are substantially the same size, and wherein the first vial and the second vial are substantially the same size; and d. two caps, each cap having an open end and a closed end, the cap designed to accept the cap insert into the open end, wherein one of the cap and the cap insert have at least one protrusion and the other of the cap and the cap insert have at least one recess to accommodate the at least one protrusion, wherein the at least one protrusion and at least one recess prevent rotation of the cap insert when placed within the cap, wherein the cap insert comprises a rod, wherein the rod is configured to accept an applicator tip, and wherein the rod is configured to be inserted into the vial when the cap is placed over the first opening or the second opening of the central container.

2. The container of claim 1, wherein the first vial and the second vial are positioned closer to the center of the central container than the first cap and the second cap.

3. The container of claim 1, where in the rod is configured to accept a plurality of applicator tip styles.

4. The container of claim 1, further comprising a wiper positioned at a top end of the first vial such that the applicator contacts the wiper when the applicator is removed from the vial.

5. The container of claim 1, wherein the first vial and a first cap insert have complementary threads for removably coupling the first vial and the first cap insert, and wherein the second vial and a second cap insert have complementary threads for removably coupling the second vial and the second cap insert.

* * * * *